US010362383B2

(12) United States Patent
Yu

(10) Patent No.: US 10,362,383 B2
(45) Date of Patent: Jul. 23, 2019

(54) EAR HANGING TYPE MUSIC PLAYER

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Pan Yu, Shenzhen (CN)

(73) Assignee: Fu Tai Hua Industry (Shenzhen) Co., Ltd., Shenzhen (CN)

( * ) Notice: Subject to any disclaimer, the term of this patent is extended or adjusted under 35 U.S.C. 154(b) by 47 days.

(21) Appl. No.: 15/790,076

(22) Filed: Oct. 23, 2017

(65) Prior Publication Data

US 2019/0098389 A1 Mar. 28, 2019

(30) Foreign Application Priority Data

Sep. 28, 2017 (CN) ..... 2017 1 0901330

(51) Int. Cl.
*H04R 1/00* (2006.01)
*H04R 1/10* (2006.01)

(52) U.S. Cl.
CPC ..... *H04R 1/1016* (2013.01); *H04R 1/105* (2013.01); *H04R 1/1033* (2013.01); *H04R 1/1041* (2013.01); *H04R 1/1058* (2013.01); *H04R 2420/09* (2013.01)

(58) Field of Classification Search
CPC ... H04R 1/1016; H04R 1/1033; H04R 1/1066
See application file for complete search history.

(56) References Cited

U.S. PATENT DOCUMENTS

| | | | | |
|---|---|---|---|---|
| 8,249,286 | B2 * | 8/2012 | Nault | H04R 1/1033 381/380 |
| 9,106,997 | B2 * | 8/2015 | Burgett | H04R 1/105 |
| 9,247,353 | B2 * | 1/2016 | Bewley | H04R 25/556 |
| 9,826,302 | B2 * | 11/2017 | Nguyen | H04R 1/105 |
| 9,942,645 | B2 * | 4/2018 | Prelogar | H04R 1/1066 |
| 9,973,842 | B2 * | 5/2018 | Kim | H04R 1/1025 |
| 2004/0096079 | A1 * | 5/2004 | Chang | H04R 1/1016 381/374 |
| 2007/0053543 | A1 * | 3/2007 | Lee | H04M 1/05 381/381 |
| 2007/0133836 | A1 * | 6/2007 | Lee | H04M 1/05 381/370 |
| 2007/0248238 | A1 * | 10/2007 | Abreu | G02C 3/003 381/381 |
| 2007/0263896 | A1 * | 11/2007 | Chen | H04R 1/105 381/381 |
| 2008/0144854 | A1 * | 6/2008 | Abreu | G02C 3/003 381/74 |

(Continued)

*Primary Examiner* — Matthew A Eason
(74) *Attorney, Agent, or Firm* — ScienBiziP, P.C.

(57) ABSTRACT

An ear hanging type music player includes a left ear hanger and a right ear hanger. The left ear hanger includes a first hanging main body and a first ear plug. The first hanging main body includes a first earplug receiving groove, the first ear plug is movably received in the first earplug receiving groove. The right ear hanger includes a second hanging main body and a second ear plug. The second hanging main body has a same structure as the first hanging main body, the second hanging main body includes a second earplug receiving groove, the second ear plug is movably received in the second earplug receiving groove.

16 Claims, 6 Drawing Sheets

(56) References Cited

U.S. PATENT DOCUMENTS

| | | | | |
|---|---|---|---|---|
| 2008/0247590 | A1* | 10/2008 | Sun | H04R 1/105 381/381 |
| 2008/0298626 | A1* | 12/2008 | Dean | H04R 1/105 381/381 |
| 2008/0310666 | A1* | 12/2008 | Wengreen | H04R 1/026 381/381 |
| 2008/0317274 | A1* | 12/2008 | Kim | H04R 1/1058 381/370 |
| 2009/0069060 | A1* | 3/2009 | Kim | A45F 5/02 455/575.6 |
| 2009/0226024 | A1* | 9/2009 | Dean | H04R 1/1016 381/379 |
| 2010/0124349 | A1* | 5/2010 | Bass | H04R 1/10 381/379 |
| 2010/0254563 | A1* | 10/2010 | Harper | H04R 1/1033 381/375 |
| 2011/0170731 | A1* | 7/2011 | Beckhart | H04R 1/105 381/381 |
| 2013/0114842 | A1* | 5/2013 | Jennings | H04R 1/105 381/380 |
| 2014/0211959 | A1* | 7/2014 | Boyajian | H04R 1/1041 381/74 |
| 2015/0181325 | A1* | 6/2015 | Urup | H04R 1/1091 381/74 |
| 2016/0098138 | A1* | 4/2016 | Park | G06F 3/0416 345/173 |

* cited by examiner

EAR HANGING TYPE MUSIC PLAYER

FIELD

The subject matter herein generally relates to a music player, and, especially, to an ear hanging type music player.

BACKGROUND

Recently, with the rapid development of electronic products, all kinds of movies and music can be conveniently played and appreciated, and earphones have become a must-have accessory of electronic products. However, traditional earphones usually have two long cables, and the long cables can easily twist together, and they are also inconvenient to store.

Therefore, it is desirable to provide an ear hanging type music player which can overcome the above-mentioned disadvantages.

BRIEF DESCRIPTION OF THE DRAWINGS

Implementations of the present technology will now be described, by way of example only, with reference to the attached figures.

DETAILED DESCRIPTION

Figure 1:
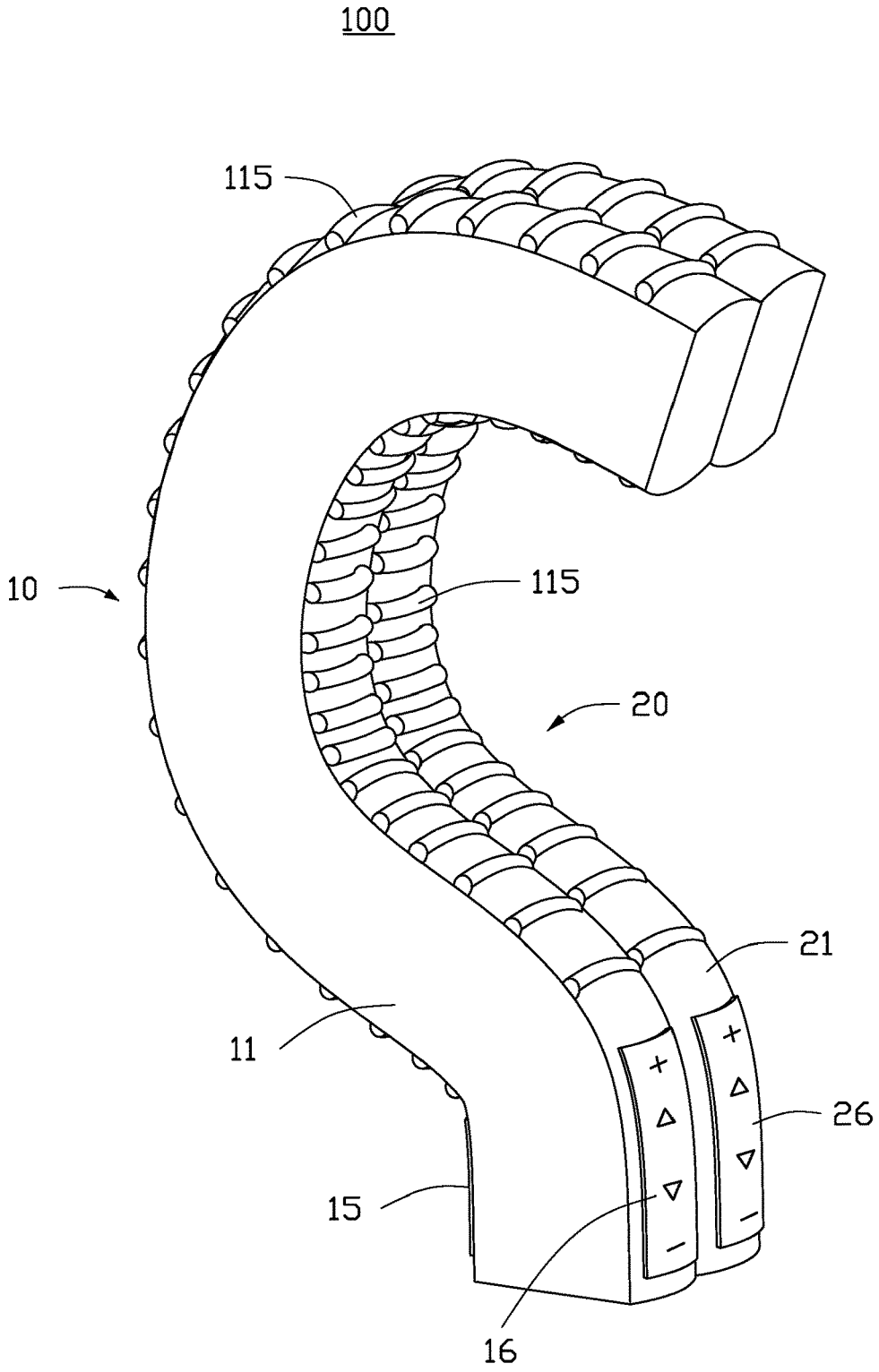
FIG. 1 is an isometric view of an ear hanging type music player in accordance with one exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to illustrate details and features of the present disclosure better. The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like. The references "a plurality of" and "a number of" mean "at least two."

Figure 2:
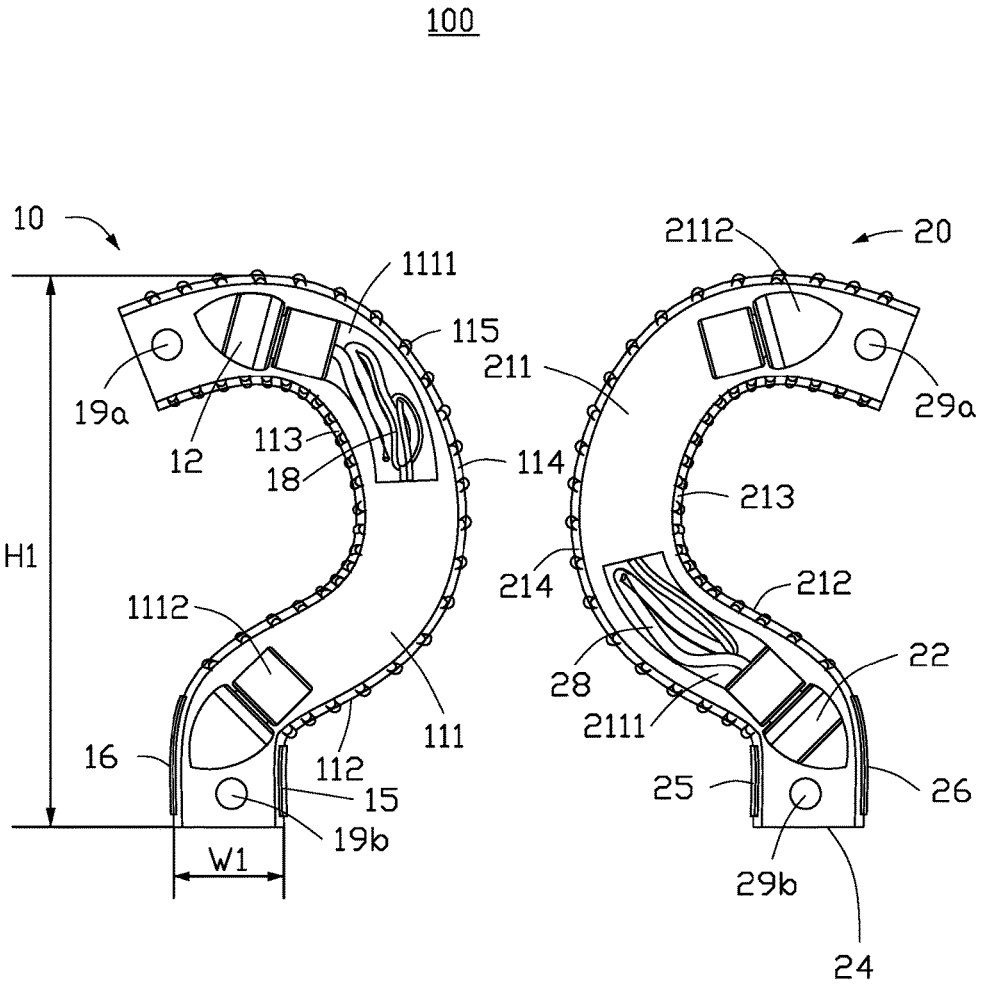
FIG. 2 is another isometric view of an ear hanging type music player in accordance with one exemplary embodiment.

FIGS. 1-2 illustrate an ear hanging type music player 100 according to one embodiment. The ear hanging type music player 100 includes a left ear hanger 10 and a right ear hanger 20. The left ear hanger 10 is detachably fixable with the right ear hanger 20.

Figure 4:
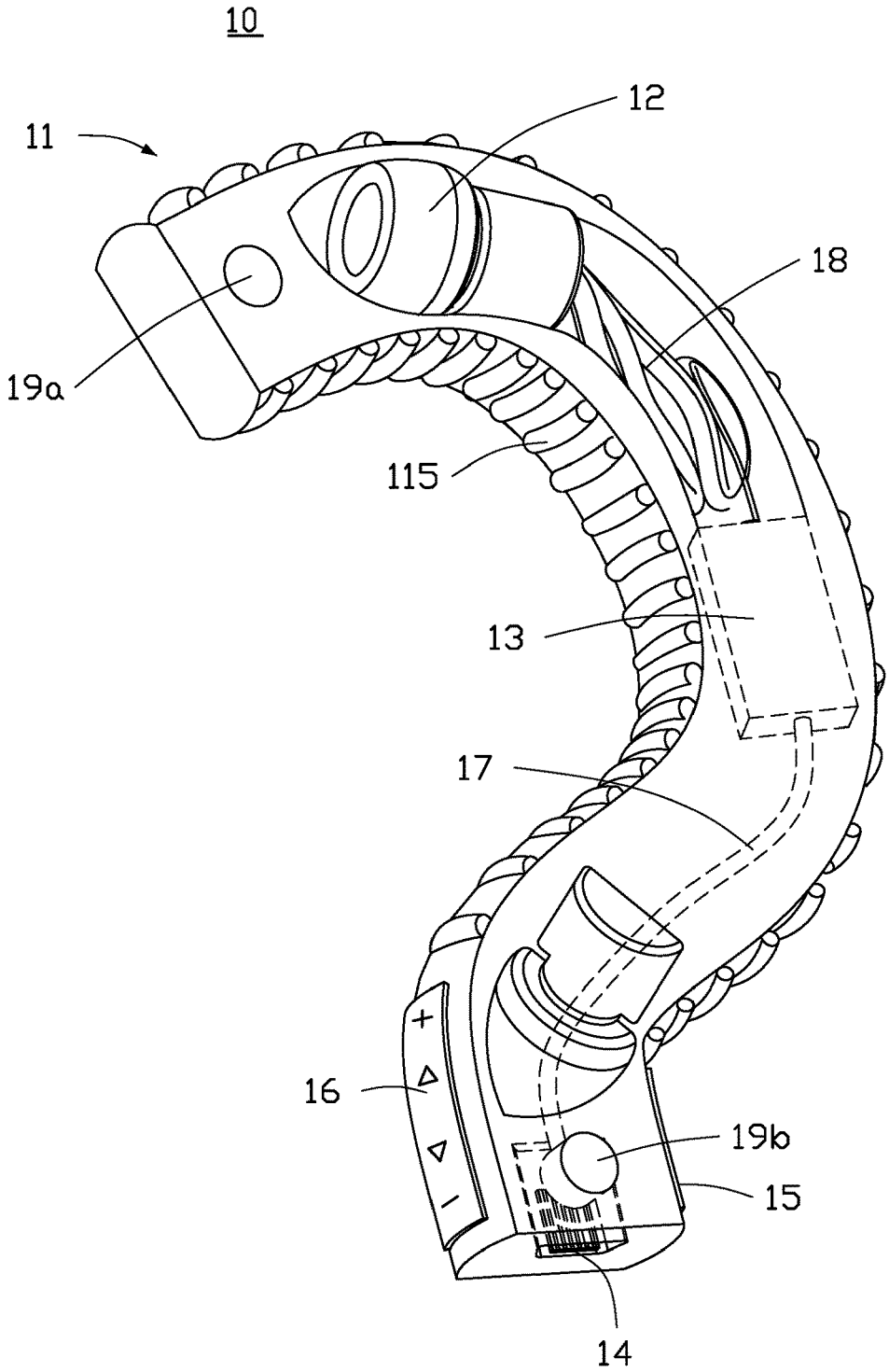
FIG. 4 is a perspective view of the left ear hanger.

As shown in FIG. 4, the left ear hanger 10 includes a first hanging main body 11, a first ear plug 12, a first motherboard 13, a first USB interface 14, a first power switch 15, a first adjustment button 16, a first connecting wire 17, a first earphone cable 18 and at least one first fixing member 19. A total height of the left ear hanger 10 (H1) is about 80 millimeters, as shown in FIG. 2.

As shown in FIG. 2, the first hanging main body 11 is substantially arc-shaped and conforms with the basic shape of a human ear. The first hanging main body 11 includes a first fixing surface 111, a first back surface 112 opposite to the first fixing surface 111, a first side surface 113 and a second side surface 114 opposite to the first side surface 113. The first side surface 113 and the second side surface 114 connect the first fixing surface 111 and the first back surface 112 respectively. In the illustrated embodiment, the first fixing surface 111 and the first back surface 112 are flat, the first side surface 113 and the second side surface 114 are cambered surfaces.

Figure 5:
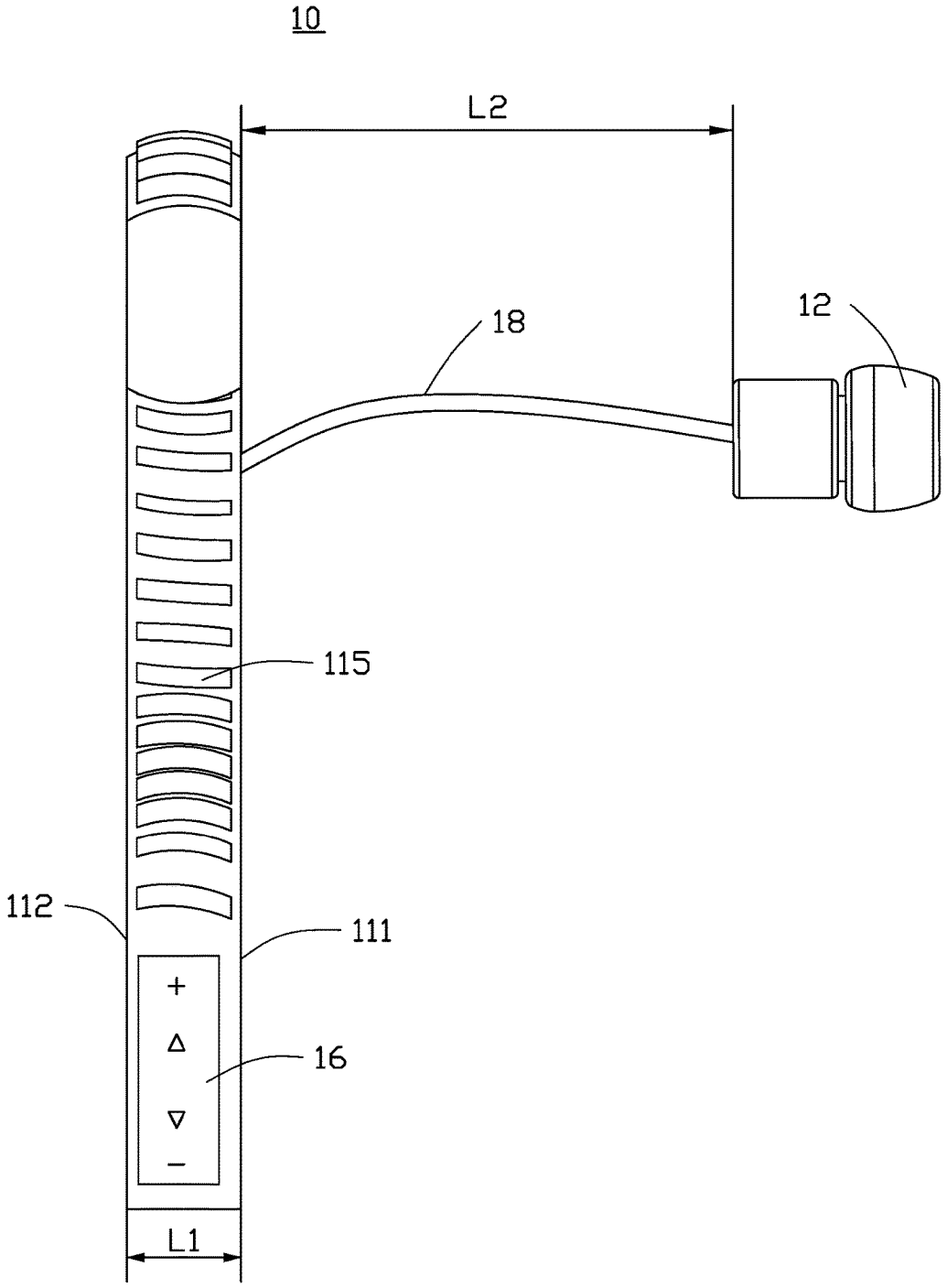
FIG. 5 is a side view of the left ear hanger.

A distance between the first fixing surface 111 and the first back surface 112 is L1 as shown in FIG. 5. L1 is about 8 millimeters or less than 8 millimeters, that is, a thickness of the left ear hanger 10 is about 8 millimeters. A distance between the first side surface 113 and the second side surface 114 is W1, and W1 is about 18 millimeters or less than 18 millimeters, thereby the left ear hanger 10 is lightweight.

The first fixing surface 111 defines a first earplug receiving groove 1111 and a first containing groove 1112. The first earplug receiving groove 1111 is arranged adjacent to an upper end of the first fixing surface 111, the first containing groove 1112 is arranged adjacent to a lower end of the first fixing surface 111. Both the first side surface 113 and the second side surface 114 are provided with a plurality of first antiskid ribs 115. The first antiskid ribs 115 ensure firm and secure contact with the left ear hanger 10.

As shown in FIG. 4, the first ear plug 12 is electrically connected with the first motherboard 13 via the first earphone cable 18. A depth of the first earplug receiving groove 1111 is less than a thickness of the first ear plug 12, the first ear plug 12 is received in the first earplug receiving groove 1111 and protrudes from the first fixing surface 111. Thereby, the first hanging main body 11 is more lightweight. The first earphone cable 18 is foldably received in the first earplug receiving groove 1111. A length of the first earphone cable 18 is L2, and L2 in a range of 20~80 millimeters, as shown in FIG. 5.

The first connecting wire 17 is connected to the first USB interface 14 and the first motherboard 13. The first motherboard 13, the first USB interface 14, and the first connecting wire 17 are buried in the first hanging main body 11.

Figure 3:
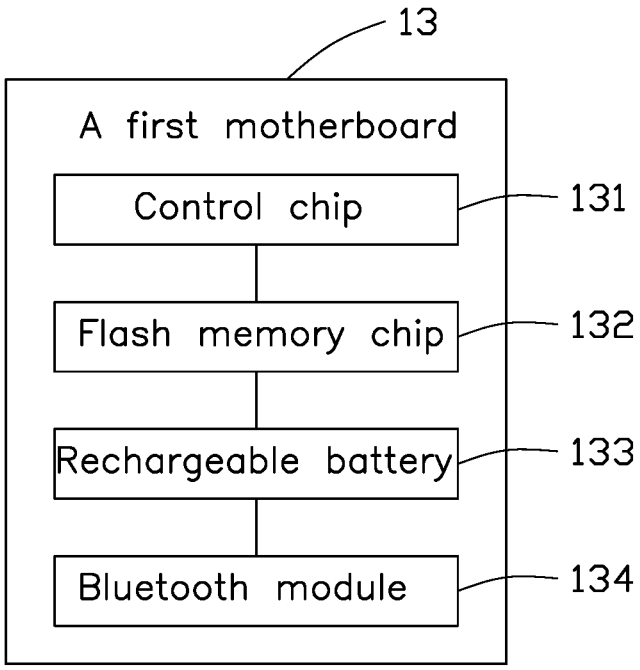
FIG. 3 is function module block view of a first motherboard of the left ear hanger of the player of FIG. 1.

The first motherboard 13 is integrated with a control chip 131 configuring to control the hanging type music player 100 to play, a flash memory chip 132, a rechargeable battery 133, a BLUETOOTH module 134, as shown in FIG. 3.

The first USB interface 14 is exposed at bottom end of the first hanging main body 11, the first USB interface 14 is configured for electrical charging or data transmission.

As shown in FIG. 2, the first power switch 15 is located at the second side surface 114 and adjacent to the bottom of the first hanging main body 11. The adjustment button 16 is located at the first side surface 113 and adjacent to the bottom of the first hanging main body 11. The adjustment button 16 includes a sound volume button, a fast-forward button, and a back button. The sound volume button is configured to adjust sound volume of the ear plug 12, and the fast-forward and back buttons are configured to fast forward and rewind playing content.

The first fixing members 19 are embedded in the first hanging main body 11 and exposed by the first fixing surface 111. The first fixing surface 111 is arranged with at least one first fixing member 19. The first fixing members 19 can be a fastening member, a magic tape, or a magnet. In the illustrated embodiment, the at least one first fixing member 19 is a magnet, and the number of the first fixing members 19 is two, the two first fixing members 19 are arranged at opposite ends of the first fixing surface 111.

The right ear hanger 20 has a structure substantially the same as the left ear hanger 10. A total height of the right ear hanger 20 is also about 80 millimeters. The right ear hanger 20 includes a second hanging main body 21, a second ear plug 22, a second motherboard (not shown), a second USB interface, a second power switch 25, a second adjustment button 26, a second connecting wire (not shown), a second earphone cable 28, and a second fixing member 29, a second connecting wire and a second motherboard in the right ear hanger 20 are same as a first connecting wire 17 and a first motherboard 13 in the left ear hanger 10, so the second connecting wire and the second motherboard are not shown, and this does not affect the understanding of the structure of the right ear hanger 20.

The second hanging main body 21 is substantially arc-shape and conforms with the basic shape of a human ear, as shown in FIG. 2. The second hanging main body 21 includes a second fixing surface 211, a second back surface 212 opposite to the second fixing surface 211, a third side surface 213, and a fourth side surface 214 opposite to the third side surface 213. The third side surface 213 and the fourth side surface 214 connect to the second fixing surface 211 and the second back surface 212 respectively. In the illustrated embodiment, the second fixing surface 211 and the second back surface 212 are flat, the third side surface 213 and the fourth side surface 214 are cambered surfaces.

A thickness of the right ear hanger 20 is equal to a thickness of the left ear hanger 10. A distance between the third side surface 213 and the fourth side surface 214 is equal to a distance between the first side surface 113 and the second side surface 114.

The second fixing surface 211 defines a second earplug receiving groove 2111 and a second containing groove 2112. The second earplug receiving groove 2111 is arranged adjacent to a lower end of the second fixing surface 211, the second containing groove 2112 is arranged an upper end of the second fixing surface 211. The first fixing surface 111 of the first hanging main body 11 contacts with the second fixing surface 211 of the second hanging main body 21, the second earplug receiving groove 2111 matches with the first containing groove 1112 and together they receive the second ear plug 22; and the second containing groove 2112 matches with the first earplug receiving groove 1111 and together they receive the first ear plug 12. The third side surface 213 and the fourth side surface 214 are also provided with a plurality of second antiskid ribs 215. The second antiskid ribs 215 ensure firm and secure contact with the right ear hanger 20.

The second ear plug 22 is electrically connected with the motherboard 23 via the second earphone cable 28. A depth of the second earplug receiving groove 2111 is less than a thickness of the second ear plug 22, the second ear plug 22 is received in the second earplug receiving groove 2111 and protrudes from the second fixing surface 211. Thereby, the second hanging main body 21 is more lightweight. The second earphone cable 28 is foldably received in the second earplug receiving groove 2111. A length of the second earphone cable 28 is in a range of 20~80 millimeters.

The second connecting wire is connected to the second USB interface and the motherboard, can be refer to FIG. 4. The second motherboard, the second USB interface, and the second connecting wire are buried in the second hanging main body 21. The second motherboard is integrated with a rechargeable battery and a Bluetooth module. Of course, the second motherboard is also can be integrated with a control chip, a flash memory chip, thereby, the right ear hanger 20 is can be used singly or in combination with the left ear hanger 10. The Bluetooth module in the right ear hanger 20 can communicate with the Bluetooth module in the left ear hanger 10, so the second motherboard does not need to include a flash memory chip and a control chip.

The second USB interface is exposed at bottom end of the second hanging main body 21. The second USB interface is configured for charging or data transmission.

The second power switch 25 is located at the fourth side surface 214 and adjacent to the bottom of the second hanging main body 21. The adjustment button 16 is located at the fourth side surface 214 and adjacent to the bottom of the second hanging main body 21. The adjustment button 16 includes a sound volume button, a fast-forward button, and a back button. The sound volume button is configured to adjust sound volume of the first ear plug 12, the fast-forward button and the back button are configured to fast forward and rewind back of playing content, respectively.

The second fixing member 29 is arranged on the second fixing surface 211 of the second hanging main body 21. The second fixing surface 211 is arranged with at least one second fixing member 29. The second fixing member 29 and the first fixing member 19 are configured to fix the right ear hanger 20 with the right ear hanger 20 together. The second fixing member 29 can be a fastening member, a magic tape, or a magnet. In the illustrated embodiment, the second fixing member 29 is a magnet, and the number of the second fixing members 29 is two, the two second fixing members 29 are arranged at two opposite ends of the second fixing surface 211, and the second fixing member 29*a* matches with the first fixing member 19*a*, the second fixing member 29*b* matches with the first fixing member 19*b*.

Figure 6:
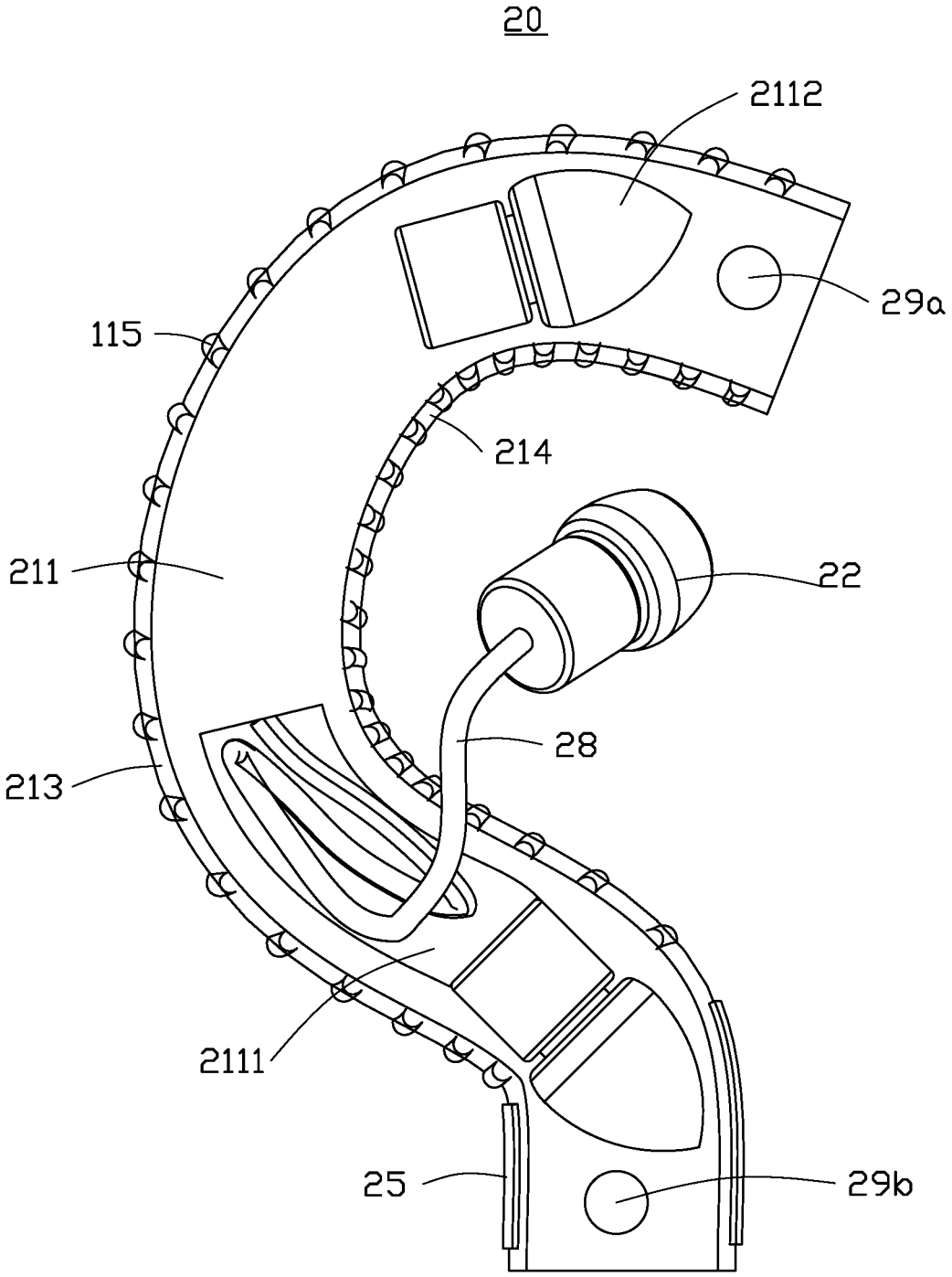
FIG. 6 shows the ear hanging type music player being worn.

When the ear hanging type music player 100 is in use, as shown in FIG. 5 and FIG. 6, the left ear hanger 10 is separated from the right ear hanger 20. The left ear hanger 10 is hooked on a left ear, and right ear hanger 20 is hooked on a right ear, and the first ear plug 12 is removed from the first ear plug receiving groove 1111 and plugged into the left ear, the second ear plug 22 is removed from the second earplug receiving groove 2111 and plugged into the right ear. The first power switch 15 and the second power switch 25 are turned on, and songs stored in the first motherboard 13 can be played.

When the ear hanging type music player 100 is not in use, the first ear plug 12 is disposed in the first earplug receiving groove 1111, and the first earphone cable 18 is foldably received in the first earplug receiving groove 1111. The second ear plug 22 is disposed in the second earplug receiving groove 2111, the second earphone cable 28 is foldably received in the second earplug receiving groove 2111, and the first fixing surface 111 is fitted to the second fixing surface 211. The left ear hanger 10 is fixed with the right ear hanger 20 by the first fixing member 19 and the second fixing member 29, and the first ear plug 12 is received in a space formed by the first earplug receiving groove 1111 and the second containing groove 2112. The second ear plug 22 is received in a space formed by the second earplug receiving groove 2111 and the first containing groove 1112.

The embodiments shown and described above are only examples. Therefore, many commonly-known features and details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will, therefore, be appreciated that the embodiments described above may be modified within the scope of the claims.

What is claimed is:

1. An ear hanging type music player comprising:

an ear hanger comprising a hanging main body and an ear plug, wherein the hanging main body comprises an earplug receiving groove, the ear plug is movably received in the earplug receiving groove;

wherein the ear hanger comprises a left ear hanger and a right ear hanger, the left ear hanger comprises a first hanging main body and a first ear plug, the first hanging main body comprises a first earplug receiving groove, the first ear plug is movably received in the earplug receiving groove; the right ear hanger comprises a second hanging main body and a second ear plug, the second hanging main body has same structure as the first hanging main body, the second hanging main body comprises a second earplug receiving groove, the second ear plug is movably received in the second earplug receiving groove, a depth of the first earplug receiving groove is less than a thickness of the first ear plug, the first ear plug is received in the first earplug receiving groove and protrudes from the first earplug receiving groove; a depth of the second earplug receiving groove is less than a thickness of the second ear plug, the second ear plug is received in the second earplug receiving groove and protrudes from the second earplug receiving groove, the first hanging main body further comprises a first containing groove matching with the second earplug receiving groove, the second earplug receiving groove and the first containing groove together receive the second ear plug, the second hanging main body further comprises a second containing groove matching with the first earplug receiving groove, the first earplug receiving groove and the second containing groove together receive the first ear plug.

2. The ear hanging type music player of claim 1, wherein the first hanging main body is substantially arc-shaped, the first hanging main body comprises a first fixing surface, a first back surface opposite to the first fixing surface, a first side surface and a second side surface opposite to the first side surface, the first side surface and the second side surface connect the first fixing surface and the first back surface; the first fixing surface and the first back surface are flat, the first side surface and the second side surface are cambered surfaces.

3. The ear hanging type music player of claim 2, wherein both the first side surface and the second side surface comprise a plurality of antiskid ribs.

4. The ear hanging type music player of claim 1, wherein the left ear hanger further comprises a first motherboard and a first earphone cable, the first motherboard and the first earphone cable are buried in the first hanging main body, the first ear plug is electrically connected with the first motherboard via the first earphone cable, the first earphone cable is foldably received in the first earplug receiving groove.

5. The ear hanging type music player of claim 4, wherein the left ear hanger further comprises a first Universal Serial Bus interface and a first connecting wire, the first connecting wire connects the first USB interface and the first motherboard, the first Universal Serial Bus interface and the first connecting wire are buried in the first hanging main body and the first USB interface is exposed at bottom end of the first hanging main body.

6. The ear hanging type music player of claim 5, wherein the left ear hanger further comprises a first power switch located at the second side surface and adjacent to the bottom of the first hanging main body, and a first adjustment button located, at the first side surface and adjacent to the bottom of the first hanging main body.

7. The ear hanging type music player of claim 1, wherein the left ear hanger further comprises at least one first fixing member, the first fixing member is embedded in the first hanging main body and exposed at the first fixing surface, the second ear hanger further comprises at least one second fixing member, the second fixing member is embedded in the second hanging main body and exposed at the second fixing surface, the at least one first fixing member matches with the at least one second fixing member, and the left ear hanger is fixed with the right ear hanger using the at least one first fixing member and the at least one second fixing member.

8. The ear hanging type music player of claim 7, wherein the first fixing member is a fastening member, a magic tape or a magnet.

9. An ear hanging type music player comprising:

a left ear hanger comprising a first hanging main body and a first ear plug movably fixed on the first hanging main body, wherein the first hanging main body comprises a first fixing surface, the first fixing surface is arranged with a first fixing member; and a right ear hanger comprising a second hanging main body and a second ear plug movably fixed on the second hanging main body, wherein the second hanging main body comprises a second fixing surface toward the first fixing surface, the second fixing surface is arranged with a second fixing member, the first fixing member matches with the second fixing member, and the left ear hanger is fixed with the right ear hanger using the first fixing member and the second fixing member;

wherein the first hanging main body is substantially arc-shaped, the first hanging main body further comprises a first back surface opposite to the first fixing surface, a first side surface and a second side surface opposite to the first side surface, the first side surface and the second side surface connect the first fixing surface and the first back surface.

10. The ear hanging type music player of claim 9, wherein the first fixing surface defines a first earplug receiving groove, the first ear plug is movably received in the first earplug receiving groove; the second fixing surface defines a second earplug receiving groove, the second ear plug is movably received in the second earplug receiving groove.

11. The ear hanging type music player of claim 10, wherein a depth of the first earplug receiving groove is less than a thickness of the first ear plug, the first ear plug is received in the first earplug receiving groove and protrudes from the first earplug receiving groove; a depth of the second earplug receiving groove is less than a thickness of the second ear plug, the second ear plug is received in the second earplug receiving groove and protrudes from the second earplug receiving groove.

12. The ear hanging type music player of claim 11, wherein the first hanging main body further comprises a first containing groove matching with the second earplug receiving groove, the second earplug receiving groove and the first containing groove together configured to receive the second ear plug, the second hanging main body further includes a second containing groove matching with the first earplug receiving groove, the first earplug receiving groove and the second containing groove together configured to receive the first ear plug.

13. The ear hanging type music player of claim 9, wherein both the first side surface and the second side surface are arranged with a plurality of antiskid ribs.

14. The ear hanging type music player of claim 9, wherein the left ear hanger further comprises a first motherboard and a first earphone cable, the first motherboard and the first earphone cable are buried in the first hanging main body, the first ear plug is electrically connected with the first motherboard via the first earphone cable, the first earphone cable is foldably received in the earplug receiving groove.

15. The ear hanging type music player of claim 14, wherein the left ear hanger further comprises a first Universal Serial Bus interface and a first connecting wire, the first connecting wire connect the first Universal Serial Bus interface and the first motherboard, the first Universal Serial Bus interface and the first connecting wire are buried in the first hanging main body and the Universal Serial Bus interface is exposed at bottom end of the first hanging main body.

16. The ear hanging type music player of claim 15, wherein the left ear hanger further comprises a first power switch located at the second side surface and adjacent to the bottom of the first hanging main body, and an adjustment button located at the first side surface and adjacent to the bottom of the first hanging main body.

* * * * *